US009241525B2

(12) United States Patent
Alex

(10) Patent No.: US 9,241,525 B2
(45) Date of Patent: Jan. 26, 2016

(54) DEVICE FOR HAIR ADDITION

(75) Inventor: Günter Alex, Erlangen (DE)

(73) Assignee: ARCOS DIE HAARPROFIS HANDELS GMBH, Erlangen (DE)

( * ) Notice: Subject to any disclaimer, the term of this patent is extended or adjusted under 35 U.S.C. 154(b) by 0 days.

(21) Appl. No.: 13/332,669

(22) Filed: Dec. 21, 2011

(65) Prior Publication Data

US 2012/0125356 A1 May 24, 2012

Related U.S. Application Data

(63) Continuation of application No. PCT/EP2010/058862, filed on Jun. 23, 2010.

(30) Foreign Application Priority Data

Jun. 24, 2009 (EP) ..... 09163621

(51) Int. Cl.
*A41G 3/00* (2006.01)
*A41G 5/00* (2006.01)

(52) U.S. Cl.
CPC ..... *A41G 5/008* (2013.01); *A41G 5/004* (2013.01)

(58) Field of Classification Search
CPC ..... A41G 5/008; A41G 5/004
USPC ..... 132/201, 53–56
See application file for complete search history.

(56) References Cited

U.S. PATENT DOCUMENTS 4,949,737 A * 8/1990 Nakamura et al. ..... 132/54
7,533,676 B2 * 5/2009 Sthair ..... 132/201

FOREIGN PATENT DOCUMENTS

DE 202005010845 U1 11/2005

OTHER PUBLICATIONS

International Search Report in copending related International Application PCT/EP2010/058862, mailed Jan. 31, 2012.

* cited by examiner

*Primary Examiner* — Rachel Steitz
(74) *Attorney, Agent, or Firm* — Thomas | Horstemeyer, LLP

(57) ABSTRACT

A device for hair addition comprises a band-shaped support comprising a first and a second side, an adhesive surface on its first side, and at least a first and a second partial length which each comprise a portion of the adhesive surface. Further, the device comprises a plurality of hairs which are each fixed to the second side of the support at one of their ends and which extend across and away from the support. The support is gradually plastically deformable until its first and second partial lengths lie flat against each other with their portions of the adhesive surface being arranged in between.

16 Claims, 1 Drawing Sheet

DEVICE FOR HAIR ADDITION

CROSS REFERENCE TO RELATED APPLICATIONS

This application is a continuation of International Application PCT/EP2010/058862 with an International Filing Date of Jun. 23, 2010 and claiming priority to European Patent Application No. 09 163 621.7 entitled "Vorrichtung zur Haarergänzung", filed on Jun. 24, 2009.

FIELD OF THE INVENTION

The present invention generally relates to a device for air hair addition.

Such a device may, for example, be used to add a strand of another color to the natural hair of a person or to the hairs of a wig. Such a device may, however, also be used to extend the present hair of a person. One then speaks of hair extension or of a device for hair extension. The purpose for which the device for hair addition is used, however, is not of essence of the present invention.

BACKGROUND OF THE INVENTION

It is known to put natural or artificial hairs together in tufts, and to connect these tufts to the natural hairs of a person by means of a thermoplastic glue. The secure but nevertheless unremarkable attachment of such a device for hair addition, however, is only possible by trained personnel at a high expenditure of time.

Further, it is known to undertake a hair extension in that additional hairs and natural hairs of a person are jointly guided through a clamping ring and fixed with regard to each other by compressing the clamping ring. This kind of hair addition also requires trained personnel and a high expenditure of time for a secure and unremarkable attachment.

Further, devices for hair addition comprising a band-shaped support from which the individual hairs of the hair addition are extending in a transverse direction and which is to be connected to the natural hairs of a person by means of a sewing or knotting step are known. Their connection to the natural hair of a person may also only be made in a secure and unremarkable way by trained personnel at a high expenditure of time.

Another device for hair addition comprising a band-shaped support from which the individual hairs of the hair addition are extending in a transverse direction is known from DE 20 2005 010 845 U. This device is attached to the natural hairs of a person in that two sections of a band-shaped support occupied with hairs are adhered to each other with their adhesive surfaces with a strand of the natural hair of the person being arranged in between. Thus the two sections of the support are fixed with regard to each other and to the natural hairs. Particularly, the natural hairs are hermetically enclosed between the adhesive surfaces here, what ensures a permanent fixation of the two sections of the support to the strand. At the same time, this known device for hair addition is very unremarkable in its attached state, as it displays hairs on both sides even in the area of the support. The hairs are here attached to the support in parallel to each other, and they are arranged under a matt but translucent cover. In this known device for hair addition, the support itself essentially consists of a double-sided adhesive tape which forms the adhesive surface on its one side, whereas the hairs are attached to the adhesive tape on the other side. The attachment of this known device for hair addition is much easier than in case of the previously presented devices for hair addition, but, as a rule, it nevertheless requires the employment of trained personnel.

The employment of trained personnel which is not only associated with cost but also requires that the person interested in a hair addition visits such trained personnel for a longer period of time is avoided by using little clip combs with hair band sections attached thereto. The little clip combs, however, protrude considerably and do particularly not allow the person to lie on the respective parts of the head without the little clip combs being displeasingly pressed into the scalp.

Thus, there still is a need for a device for hair addition which does not require trained personnel for a secure and unremarkable attachment and which may even be attached by the person who desires the hair addition itself.

SUMMARY OF THE INVENTION

The present invention relates to a device for hair addition comprising a band-shaped support and a plurality of hairs. The plurality of hairs are each fixed to the second side of the support at one of their ends and extend across and away from the support. The band-shaped support comprises a first and a second side, an adhesive surface on its first side, and at least a first and a second partial length which each comprise a portion of the adhesive surface; and the support is gradually plastically deformable until its first and second partial lengths lie flat against each other with their portions of the adhesive surface being arranged in between.

The present invention also relates to a goods sales unit comprising goods sales carrier and a device for hair addition body adhered to the goods sales carrier in a peelable way via an adhesive surface. This device for hair addition is substantially the same as defined in the preceding paragraph.

The present invention also relates to a use of a device for hair addition as defined above. This use comprises the steps of: plastically deformation the support to bring the two partial lengths into a V-shaped configuration with regard to each other In which the portions of the adhesive surface of the two partial lengths are facing each other; arranging a strand of natural hair of a person between the two partial lengths of the support; and pressing the two partial lengths against each other enclosing the strand between the portions of the adhesive surface.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

FIG. 5 shows the device in a first mode wherein the device is a generally flat plate.

FIG. 6 shows the device in a second, V-shaped mode. In the V-shaped mode, the device essentially remains in a stable V-shape permitting the user to insert the user's hair into the mouth of the V-shape.

DETAILED DESCRIPTION

Figure 1:
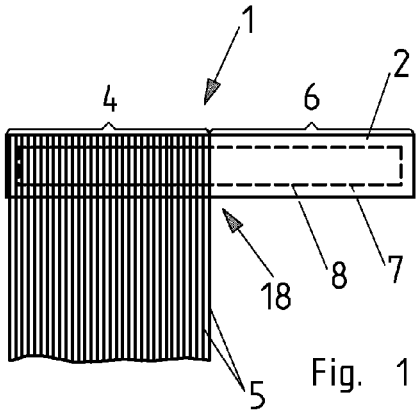
FIG. 1 is a view of a first embodiment of the new device for hair addition onto that side at which the hairs of the device are attached to its support.

In the new device for hair addition, the support to which the hairs are attached can be gradually or progressively deformed plastically until two partial lengths of the support lie flat against each other with their portions of the adhesive surface being arranged in between. Thus, the support may at first be brought into a shape in which the two partial lengths are arranged in a V-shape with regard to each other. Into the "mouth" of the device formed in this way, a strand of the natural hair of the person may be placed, about which the two partial lengths of the support are then pressed together. In doing so, the natural hairs are enclosed between the parts of the adhesive surface of the two partial lengths of the support, and the support, and thus also the hairs attached thereto, are fixed to the natural hairs of the person. This way of proceeding, which may not be realized with known devices for hair addition, requires no trained personnel, and it may, with a little skill, even be executed by a person who is interested in a hair addition itself.

That the support is progressively or gradually plastically deformable means that it may at least be deformed into the V-shape of the partial lengths of the support and at least essentially remains in this shape, and that it, also after compressing the two partial lengths of the support with their portions of the adhesive surface being arranged in between, does not tend to spring open but preferably even exerts a certain clamping force onto the natural hairs of the respective person who are arranged between the partial lengths of the support.

Such a plastic deformability is most easily realized by a plastically deformable metal inlay. Thus, a deformable metal wire arranged in one or several parallel tracks may be embedded in the support. A band-shaped metal inlay, however, may be preferred. Such a band-shaped metal inlay may virtually make up the entire support, i.e. except for the adhesive surface at its first side and for the material for attachment of the hairs at its second side. Even such a band-shaped metal inlay, however, may be embedded into a double-sided adhesive tape in that, for example, two layers of the double-sided adhesive tape are adhered to each other with the metal inlay in between. In any case, it proves to be advantageous if the plastically deformable metal inlay extends over the essential length of the support to stabilize the support in all operational positions over its entire length in its present three-dimensional configuration. Further, a plastically deformable metal inlay extending over the entire length of the support allows for an adaptation of the device for hair addition to the roundness of the head of the person interested in the hair addition in that the partial lengths of the support abutting against each other are plastically curved.

Generally, the support only needs to have a single target bending site about which it may be bent under plastic deformation. Outside this target bending site which connects the two partial lengths of the support one behind the other, the support may be stiffened, and it may, for example, be made of a plastic which, with the aid of the metal inlay, forms a film hinge in the area of the target bending site.

Generally, the hairs of the new device for hair addition may be attached to the support over the entire length of the support. Preferably, however, the hairs are only fixed to the support over one of the partial lengths of the support, whereas the adhesive surface extends over both partial lengths of the support. In this way, the attachment of the new device for hair addition is even further facilitated.

Each of the two partial lengths may make up one half of the length of the support. However, it is also possible to combine a middle partial length of the support to which hairs are attached with two partial lengths which are only half as long and which are each connected to the middle partial length via one target bending site.

Prior to using the new device, its adhesive surface is preferably covered by a peelable cover foil. The adhesive surface may be covered over each of the partial lengths of the support by means of a separate section of the protection film so that the adhesive surface over the individual partial lengths may be selectively uncovered.

Alternatively, the support of the new device for hair addition may be adhered to a goods sales carrier via its adhesive surface in a peelable way. This goods sales carrier may be provided for a single device for hair extension or for several same or different devices for hair addition.

The hairs of the new device for hair extension are preferably attached to the support in a parallel side by side arrangement. The hairs may be dyed in at least one non-natural color to be used as a hair addition in form of a dyed strand. The hairs of the new device may be artificial hairs which save cost but which also enhance their secure attachment to the support and facilitate their handling by non-trained personnel, as these hairs—in contrast to genuine hair—do not comprise scales and do thus tend to felting to a smaller extent.

The use of the present invention of a new device for hair addition has already been described in the context of the description of the device itself. At his point it should be added that the new device is preferably attached to the natural hairs of the person who desires the hair addition close to the scalp of the person to remain particularly unremarkable. This is particularly reasonable, if the hairs of the device for hair addition are to be combed together with the natural hairs of the person.

If the new device for hair addition is correctly mounted, which may be done without high skills even by non-trained personnel, it lasts for several weeks without problems. It may, however, be removed very quickly by dissolving the adhesive with alcohol, for example.

Figure 2:
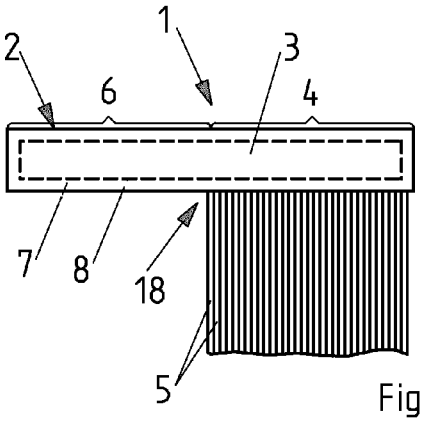
FIG. 2 is a view of the device according to FIG. 1 onto that side of the support at which its adhesive surface is provided.

Referring now in greater detail to the drawings, FIGS. 1 and 2 illustrate a device 1 for hair addition comprising a band-shaped support 2 which is covered by an adhesive surface 3 at its one side (FIG. 2). At its other side (FIG. 1), hairs 5 are attached to the support 2 over a partial length 4 in that they are adhered to the support 2 running in parallel to each other and perpendicular to the direction of main extension of the support 2. In FIGS. 1 and 2, neither the number of hairs 5 nor their length are depicted completely. The hairs 5 cover the partial length 4 in a uniform distribution; and they may have a length from several centimeters up to some decimeters. Over a second partial length 6 of the support 2 which is as long as the partial length 4, the support 2 does not comprise any appending hairs. The support 2 essentially consists of two layers of a double-sided adhesive tape between which a plastically deformable metal inlay 7 is provided. The metal inlay 7 extends over the essential length of the support 2 here. The metal inlay 7 is a band-shaped inlay 8 here, and, between the partial lengths 4 and 6, it forms a target bending site 18 of the support 2. The function of the device 1 will be further elucidated in connection with FIGS. 7 and 8.

Figure 3:
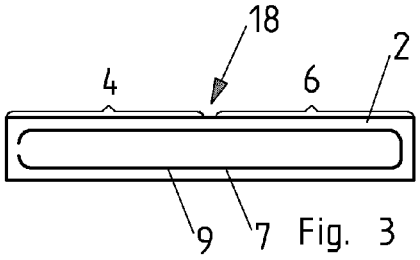
FIG. 3 shows a support of another embodiment of the new device for hair addition in a plan view.

The support of another embodiment of the device 1 illustrated in FIG. 3 comprises a plastically deformable metal inlay 7 in form of a wire instead of a band-shaped metal inlay 7. Otherwise, the second embodiment of the device corresponds to that one according to FIGS. 1 and 2.

Figure 4:
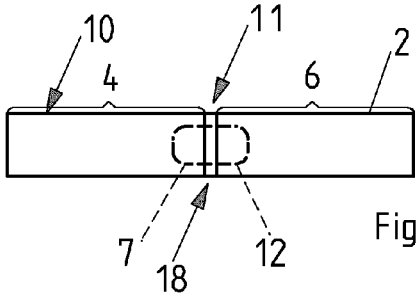
FIG. 4 shows a support of an even further embodiment of the new device for hair addition in a plan view.

The support 2 illustrated in FIG. 4 comprises a basic body 10 made of a plastic material, which is comparatively stiff in the area of the partial lengths 4 and 9 but which forms a film hinge 11 as a target bending site 18 between the partial lengths 4 and 9. The metal inlay 7 in form of a short metal band section 12 extends over this film hinge 11 within the basic body 10. The metal inlay 7 cares for that the support 2 bent into a V-shaped three-dimensional configuration about the film hinge 11 is stabilized as it will be further explained with reference to FIG. 7.

Figure 5:
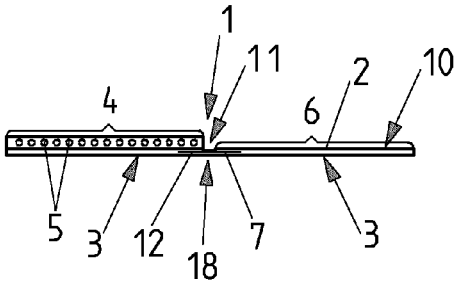
FIG. 5 is s side view of the embodiment of the new device for hair addition comprising the support according to FIG. 4.

FIG. 5 shows the embodiment of the device 1 for hair addition having the support 2 according to FIG. 4 in a side view.

Figure 6:
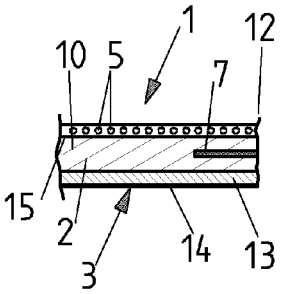
FIG. 6 is an enlarged detail of a longitudinal section through the device according to FIG. 5.

FIG. 6 depicts a detail of the construction in an enlarged longitudinal section. Here, it may be seen that an adhesive layer 13 is applied to the basic body 10 to form the adhesive surface 3. The adhesive surface is here still covered with a peelable cover foil 14. At the other side of the basic body 10 the hairs 5 of the device 1 are fixed by being embedded into a connection material 15.

Figure 7:
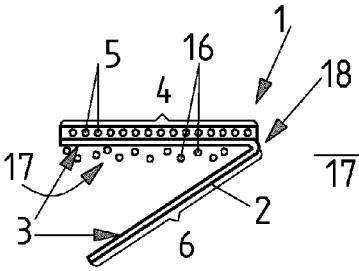
FIGS. 7 and 8 illustrate the use of the new device in the embodiment according to FIG. 1 and 2 or 5 (in FIG. 7, the partial lengths of the device are completely pressed together in a closed, clamp mode)
Figure 8:
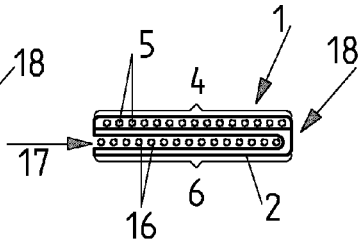

FIG. 7 shows how the partial lengths 4 and 6 of the support 2 of the device 1 according to FIGS. 1 and 2 or FIGS. 5 and 6 are bent into a V-shape in such a way that the portions of the adhesive surface 3 of the partial lengths 4 and 6 are facing each other. In this configuration, the device 1 for hair addition is arranged in relation to natural hairs 16 of a person who desires the hair addition, i.e. a strand 17 of these hairs is inserted into the V-shaped device 1. Then, the partial lengths 4 and 6 are completely pressed together, as it is depicted in FIG. 8, such that the natural hairs 16 of the strand 17 are adhered between the partial lengths 4 and 6 of the support 2. In this way, the device 1 is fixed to the strand 17. By doing so, the device 1 with the added hairs 5 does virtually not protrude beyond the natural hairs 16. In the embodiment according to FIGS. 1 and 2, the support 2 of the device 1 may also be plastically adapted to a curvature of the head in the area of the attachment of the device 1 for hair addition.

Figure 9:
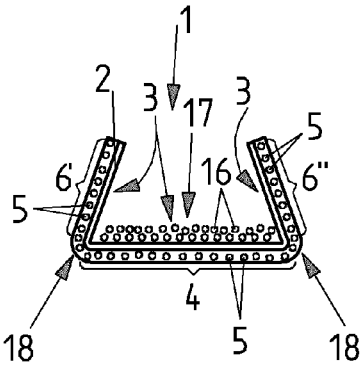
FIG. 9 illustrates the use of a further embodiment of the new device for hair addition.

FIG. 9 shows a variant of the device 1 for hair addition which differs from the embodiments described up to here in the following details. The partial length 6 which is adhered to the portion of the adhesive surface 3 of the partial length 4 with its portion of the adhesive surface 3 to enclose the natural hairs 16 and to fix the device 1 to the natural hairs 16 is divided into two separate partial lengths 6' and 6" located at both ends of the support 2. Thus, two target bending sites 18 are provided between the partial lengths 4, 6' and 6". Further, hairs 5 of the device 1 are also provided in the areas of the partial lengths 6' and 6" at the support 2. These additional hairs make handling the device 1 a little bit more complicated but increase the number of hairs 5 added 5. The common feature of the embodiments of the device 1 of all FIGS. 1 to 9 is the plastic deformability of the support 2 in the area of at least one target bending site 18.

Many variations and modifications may be made to the preferred embodiments of the invention without departing substantially from the spirit and principles of the invention. All such modifications and variations are intended to be included herein within the scope of the present invention, as defined by the following claims.

I claim:

1. A device for hair addition to complement a user's hair comprising:

an elongated band-shaped support with a first and a second partial band length separated by a hinge joint at a substantial midpoint along said elongated band-shaped support, said band-shaped support having a plastically deformable metal inlay along its length;

said band-shaped support having a first and a second side;

an adhesive surface on its first side;

said first and second partial band lengths each comprise a portion of the adhesive surface, said band-shaped support and first and second partial band lengths forming a first substantially flat planar stationary structure and a second V-shaped stationary structure bent at said hinge joint and a third closed clamp stationary structure wherein said first and second partial band lengths lay atop each other;

a plurality of hairs which are each fixed to the second side of the band-shaped support at one of their ends and which extend across and away from the support;

wherein the support is deformable about said hinge joint from said first substantially planar stationary structure into said second V-shape stationary structure and further into said third closed clamp shape stationary structure, wherein said V-shape stationary structure is adapted to capture a user's strand of hair, and wherein said closed clamp shape stationary structure said first and second partial band lengths lie flat against each other with their portions of the adhesive surface being arranged in between and adhering said captured strand of hair therebetween.

2. The device of claim 1, wherein the inlay essentially extends over the entire length of the support.

3. The device of claim 1, wherein the inlay is band-shaped.

4. The device of claim 1, wherein the inlay is a metal wire.

5. The device of claim 1, wherein the support is stiffened outside said hinge joint at one target bending site.

6. The device of claim 1, wherein the plastically deformable metal inlay extends through the hinge joint.

7. The device of claim 1, wherein the hairs are only fixed to the support over the first partial length whereas the adhesive surface provided both over the first and over the second partial length.

8. The device of claim 1, wherein each of the first and second partial lengths makes up a half of the length of the support.

9. The device of claim 1, wherein the support further comprises a third partial length, the second partial length being enclosed between the first and the third partial length, and wherein each of the first and third partial lengths makes up a quarter of the length of the support.

10. The device of claim 9, wherein the portions of the adhesive surface of the first and second partial lengths are covered with separate sections of the cover foil.

11. The device of claim 1, wherein the adhesive surface is covered with a peelable cover foil.

12. The device of claim 1, wherein the hairs fixed to the support are arranged side by side and are running in a parallel.

13. The device of claim 1, wherein the hairs are dyed in at least one non-natural color.

14. The device of claim 1, wherein the hairs are artificial hairs.

15. The device of claim 1, wherein the first and second partial band lengths are substantially equal.

16. A use of a device for hair addition to complement a user's hair comprising:

an elongated band-shaped support with a first and second partial band length separated by a hinge joint at a substantial midpoint along said elongated band-shaped support, said band-shaped support having a plastically deformable metal inlay along its length;

said band-shaped support having a first and a second side;

an adhesive surface on its first side;

said first and second partial band lengths each comprise a portion of the adhesive surface, said band-shaped support and first and second partial band lengths forming a substantially flat planar stationary structure and a V-shaped stationary structure bent at said hinge joint and a closed clamp stationary structure wherein said first and second partial band lengths lay atop each other;

a plurality of hairs which are each fixed to the second side of the band-shaped support at one of their ends and which extend across and away from the support;

wherein the support is deformable about said hinge joint from said planar stationary structure, to said V-shaped stationary structure and to said closed clamp stationary structure until its first and second partial lengths lie flat against each other with their portions of the adhesive surface being arranged in between;

the use comprises the steps of:

deforming the support about said hinge joint from said planar stationary structure and bringing the first and second partial band lengths into said V-shaped stationary structure configuration with regard to each other in which in said V-shaped stationary structure the portions of the adhesive surface of the first and second partial band lengths are facing each other;

arranging a strand of natural hair of said user between the first and second partial band lengths of the band-shaped support while in said V-shaped stationary structure; and further deforming and pressing the first and second partial band lengths against each other from said V-shaped stationary structure into said closed clamp stationary structure thereby capturing and adhering the strand between the portions of the adhesive surface.

* * * * *